US005893331A

United States Patent [19]

Diletto

[11] Patent Number: 5,893,331

[45] Date of Patent: Apr. 13, 1999

[54] BEACH AND OUTDOOR TRAY ATTACHMENT FOR LOUNGE CHAIRS AND THE LIKE

[76] Inventor: Mario Diletto, 58 Park Hill Ave., Massapequa, N.Y. 11758

[21] Appl. No.: 09/021,567

[22] Filed: Feb. 10, 1998

[51] Int. Cl.[6] ..... A47B 5/00

[52] U.S. Cl. ..... 108/48; 297/135

[58] Field of Search ..... 108/44, 42, 48, 108/152; 297/135, 160, 162, 173

[56] References Cited

U.S. PATENT DOCUMENTS

| | | | |
|---|---|---|---|
| 128,569 | 7/1872 | Vallett | 108/48 |
| 2,721,777 | 10/1955 | Willis | 108/48 X |
| 2,833,608 | 5/1958 | Tobias | 108/44 |
| 3,709,159 | 1/1973 | Oglesby, Jr. | 108/44 |
| 4,313,385 | 2/1982 | Fitzgerald | 108/48 X |
| 4,803,930 | 2/1989 | Crocoli | 108/48 |
| 5,667,272 | 9/1997 | Sutton | 108/44 X |

*Primary Examiner*—Jose V. Chen
*Attorney, Agent, or Firm*—Richard A. Joel, Esq.

[57] ABSTRACT

The structure comprises a tray of a substantially rectangular configuration having a telescoping hinged leg mounted to the bottom of the tray at one side thereof and projecting portions on the opposite side extending outwardly to fixedly engage clamp members in mating apertures. The clamp members mount to the side of a lounge chair or chaise while the telescoping leg is extended at a right angle to the tray and rests upon the ground where it is locked place. Alternative clamp members include flexible VELCRO® fasteners which are inserted through the tray slots and a C-clamp arrangement which surrounds a member on the chair for gripping purposes and is tightened thereabout by a vertical threaded member.

6 Claims, 5 Drawing Sheets

BEACH AND OUTDOOR TRAY ATTACHMENT FOR LOUNGE CHAIRS AND THE LIKE

BACKGROUND OF THE INVENTION

This invention relates to a tray attachment for a chair which is particularly useful on the beach where it may be attached to a lounge chair. The tray includes a hinged telescoping leg mounted against the base of the rectangular tray. In use the leg is moved downwardly and locked at a right angle to the tray. The tray may then be attached to a lounge chair with the leg inserted into the sand so that various items may be placed on the tray rather than on the sand itself. The tray is portable and takes up little space due to the fact that the single leg is hinged and telescoping to fit into the space beneath the tray.

In the prior art, various trays exist but none of the prior art patents disclose a compact, inexpensive tray which is readily portable and easily affixed to a lounge chair.

The prior art includes applicant's design patent, DES. 377,275 which depicts an earlier version of a tray attachment. The patent does not disclose the clamping arrangement which has proven exceedingly useful and is nowhere shown in the prior art.

U.S. Pat. No. 5,251,956 to Hofmeyer is directed to a foldable table attachment for a collapsible chair. The structure, particularly the supporting member and attaching means, are quite different from the present invention.

Other prior art patents of interest include U.S. Pat. Nos. 4,174,669 to Lalonde and 4,591,206 to Pribble. The prior art is not believed to be directly in point since applicant is proposing a unique transportable tray which may be readily affixed to a table or chair during use.

SUMMARY OF THE INVENTION

This invention relates to trays and particularly to a portable tray attachment for all types of chairs and chaises which is particularly useful on the beach.

The tray includes a substantially rectangular tabletop having upwardly extending sides and a recess at one end for holding cups. The tray also includes a pair of projecting members at one elongated end each having a slotted aperture therein to receive clamps. The clamps each include a projecting forward surface which fits into the slotted apertures and is locked therein by a snap lock tongue. The clamp further includes a rearwardly extending surface and a downwardly extending portion having a horizontal lower portion forming a substantially C-shape with the upper surface. A screw is inserted through the bottom member to fixedly attach the tray to the side frame of a lounge chair positioned within the C-shape portion.

Alternatively, a substantially C-shaped or contoured gripping clamp may be employed to lock onto the side frame of the lounge chair. A more likely and cheaper option is to have VELCRO® straps which fit through apertures in the protruding members to wrap around and secure it to lounge chairs.

Accordingly it is an object of this invention to provide a new and improved tray attachment for chairs.

Another object of this invention is to provide a new and improved tray for attachment to lounge chairs having a downwardly extending leg which mounts on the ground for purposes of support.

A still further object of this invention is to provide a new and improved tray attachment for lounge chairs which include means for readily clamping a tray attachment to the side frame of a lounge chair and a folding telescoping hinged leg which provide support for the tray.

A more specific object of this invention is to provide a new and improved tray attachment for a lounge chair which includes a tray having protruding coupling members extending outwardly therefrom and means mounted through said coupling members and attached to a chair in a ready and expeditious matter and a telescoping leg which folds against the bottom of the tray and is hinged thereto to extend at a right angle to the tray when in use.

BRIEF DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 1:
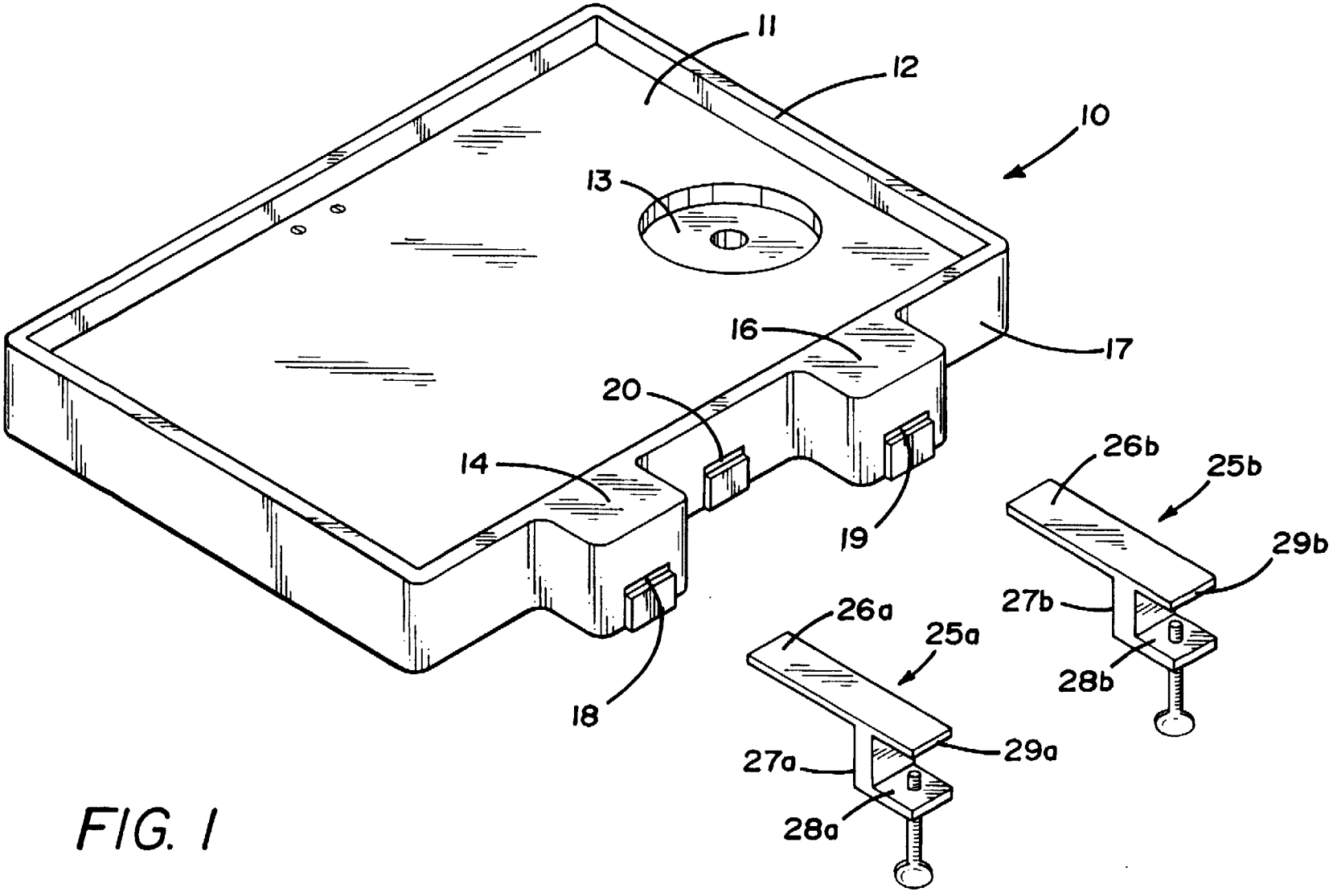
FIG. 1 discloses a perspective view of the tray having a first type of clamping members for coupling to the tray.

Referring now to the drawings, the tray 10 in FIG. 1 comprises a substantially rectangular table top 11 having upwardly projecting sides 12. The top includes a circular recess 13 to retain glasses, cans, cups, etc., in position on the tray 10. At least two projecting portions 14 and 16 extend outwardly from one of the long sides 17 of the tray 10. The projections 14 and 16 each include a slot 18 and 19 extending perpendicular to the side 17. The side 17 also includes a slot 20 which locks the projecting portion 21 of leg 22 in place against the bottom 23 of tray 10.

A pair of clamps **25*a*, 25*b* each include an elongated projecting portion 26*a*, 26*b*, a downwardly extending portion 27*a*, 27*b* and a C-shaped recess 29*a*, 29*b*. A side portion of the chair (not shown) is engaged within the recess 29*a* and 29*b*. A thumbscrew 30*a*, 30*b* is threaded through each lower portion 28*a*, 28*b* to tighten against the chair and hold it in place. The clamps 25*a*, 25*b*** are adjustable and large enough to fit almost all beach chairs.

To assemble the tray 10, the projecting portions **26*a* and 26*b* are inserted within the slots 18 and 19 respectively. The projecting 26*a* and 26*b* may be locked in place by snap lock tongues (not shown) within the slots 18 and 19. Next, the telescoping leg 30 is detached from the gripping slot 20 and pivots about hinge 31 to assume a position at right angles to the tray 10. The leg 22 locks in place at a right angle to the tray 10 by spring means associated with the hinge 31. The leg 22 may be solid or have slots along its length. The screw 32 is released permitting the leg 22 to extend outwardly to engage the ground. The leg extension 33 slides within slot 34 in the leg 22** to adjust for the desired leg height.

Figure 2:
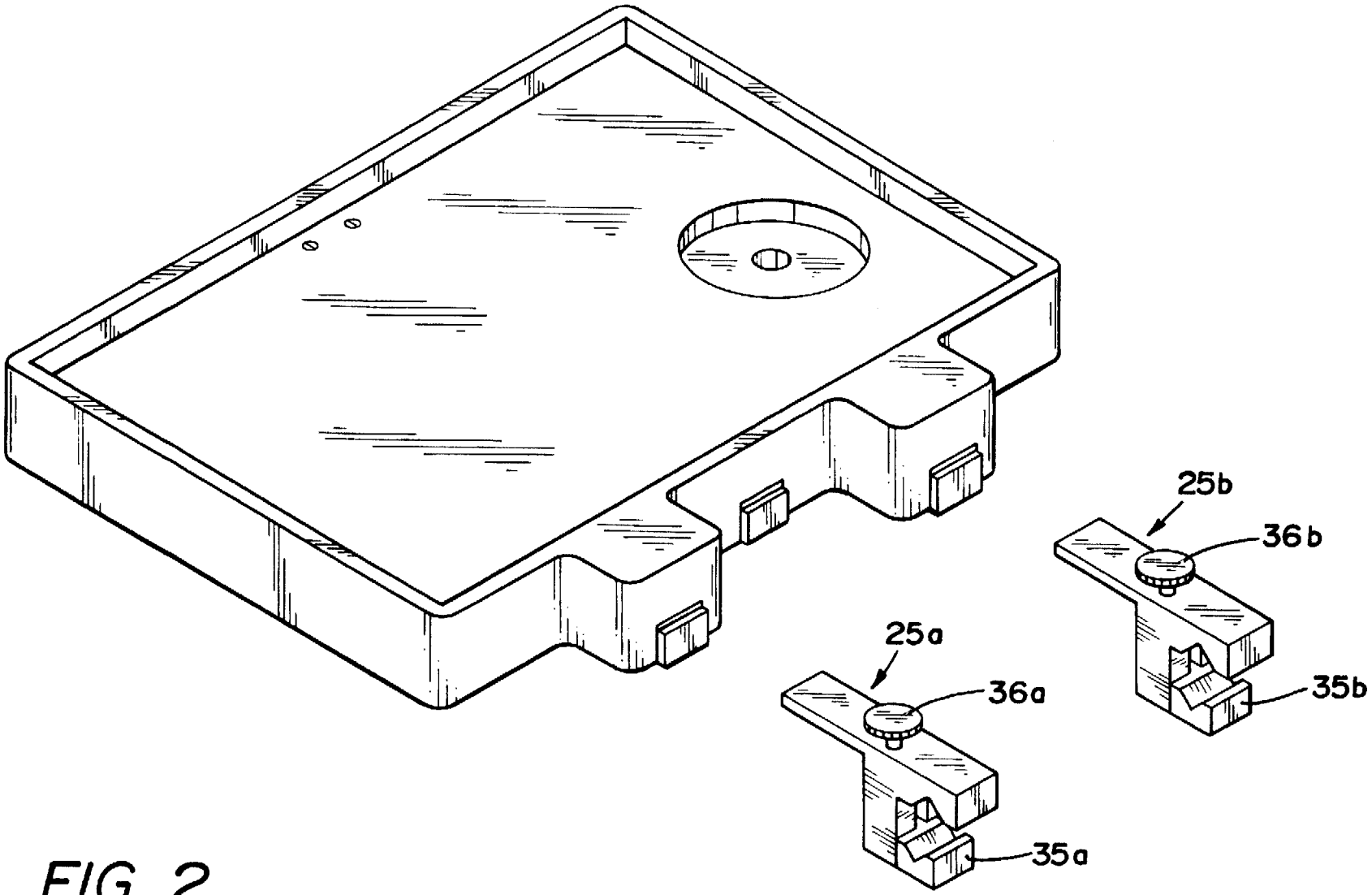
FIG. 2 discloses a perspective view of the tray having a second type of clamping members for coupling to the tray.

FIG. 2 is similar to FIG. 1 except that the clamps **25*a* and 25*b* each include mating tooth-like projections 35*a* and 35*b* which tighten about a chair by turning the knob 36*a*, 36*b*. The knobs 36*a*, 36*b* moves the lower jaw 35*b*** upwardly to grip the lower chair.

Figure 3:
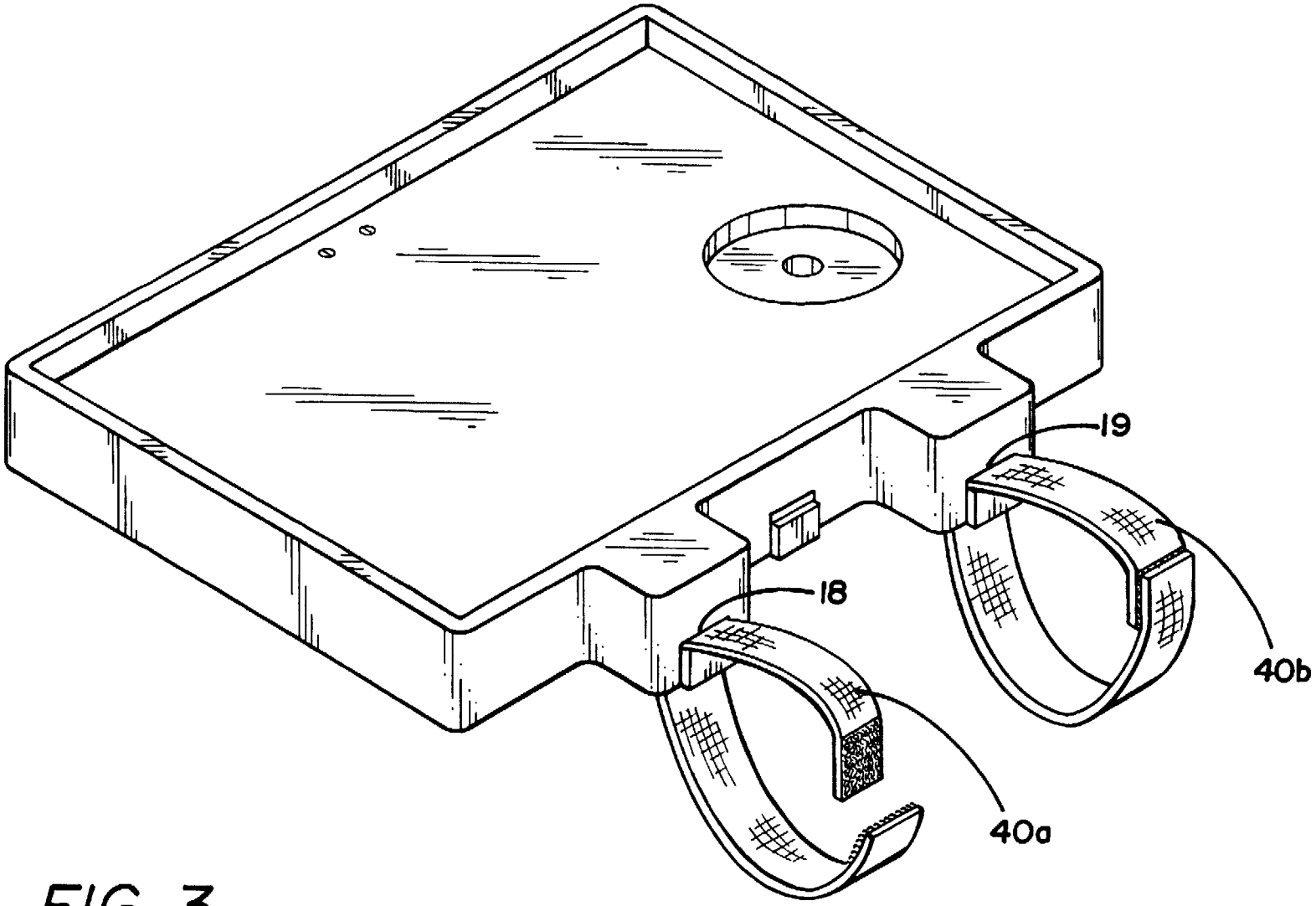
FIG. 3 discloses a perspective view of the tray having a third type of clamping means comprising VELCRO® straps for coupling to the tray.
Figure 4:
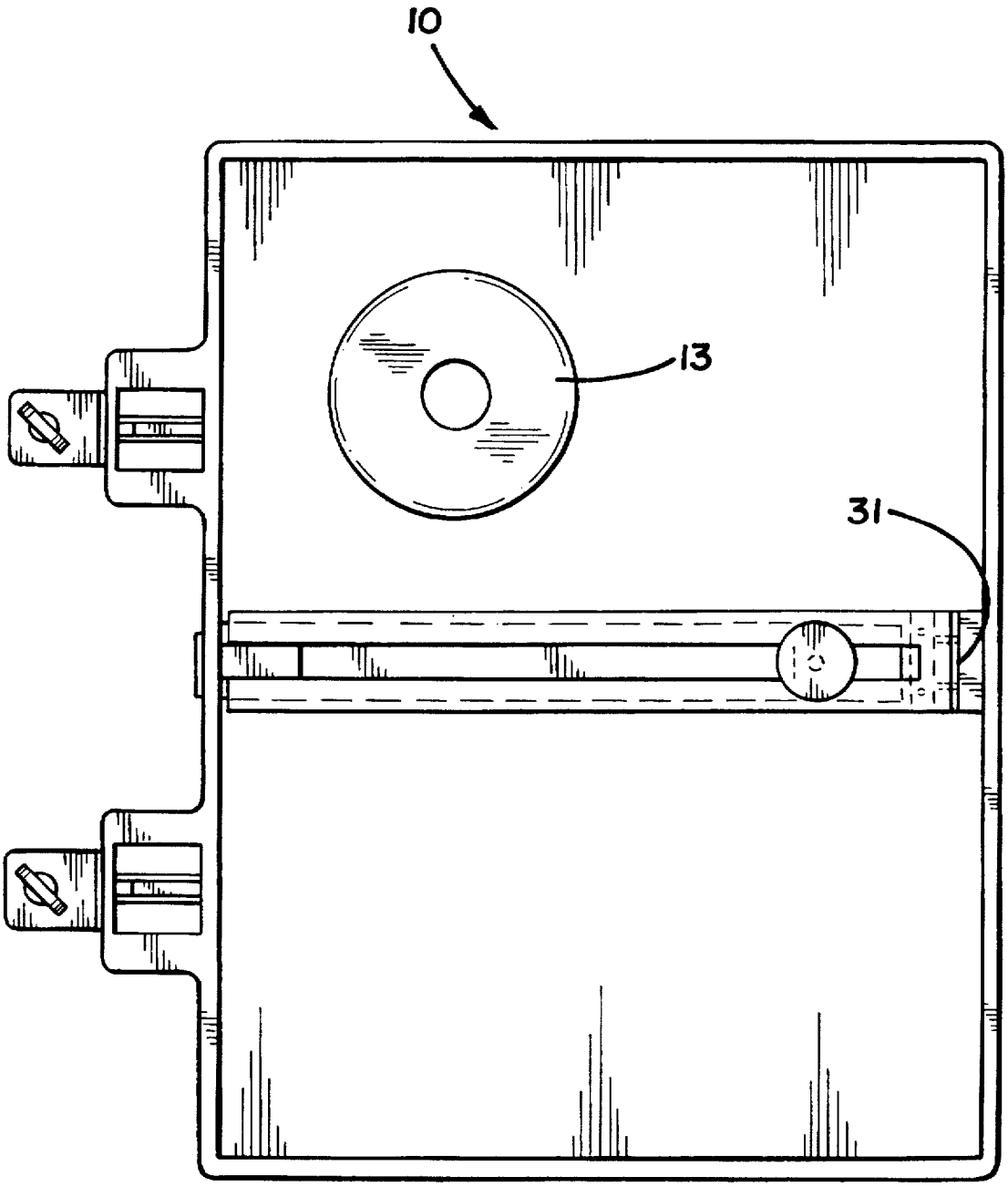
FIG. 4 discloses a bottom view of the tray showing the leg folded against the tray bottom; and, FIG. 5 discloses a side view of the tray in FIG. 1 with the leg extended and the extension in use.
Figure 5:
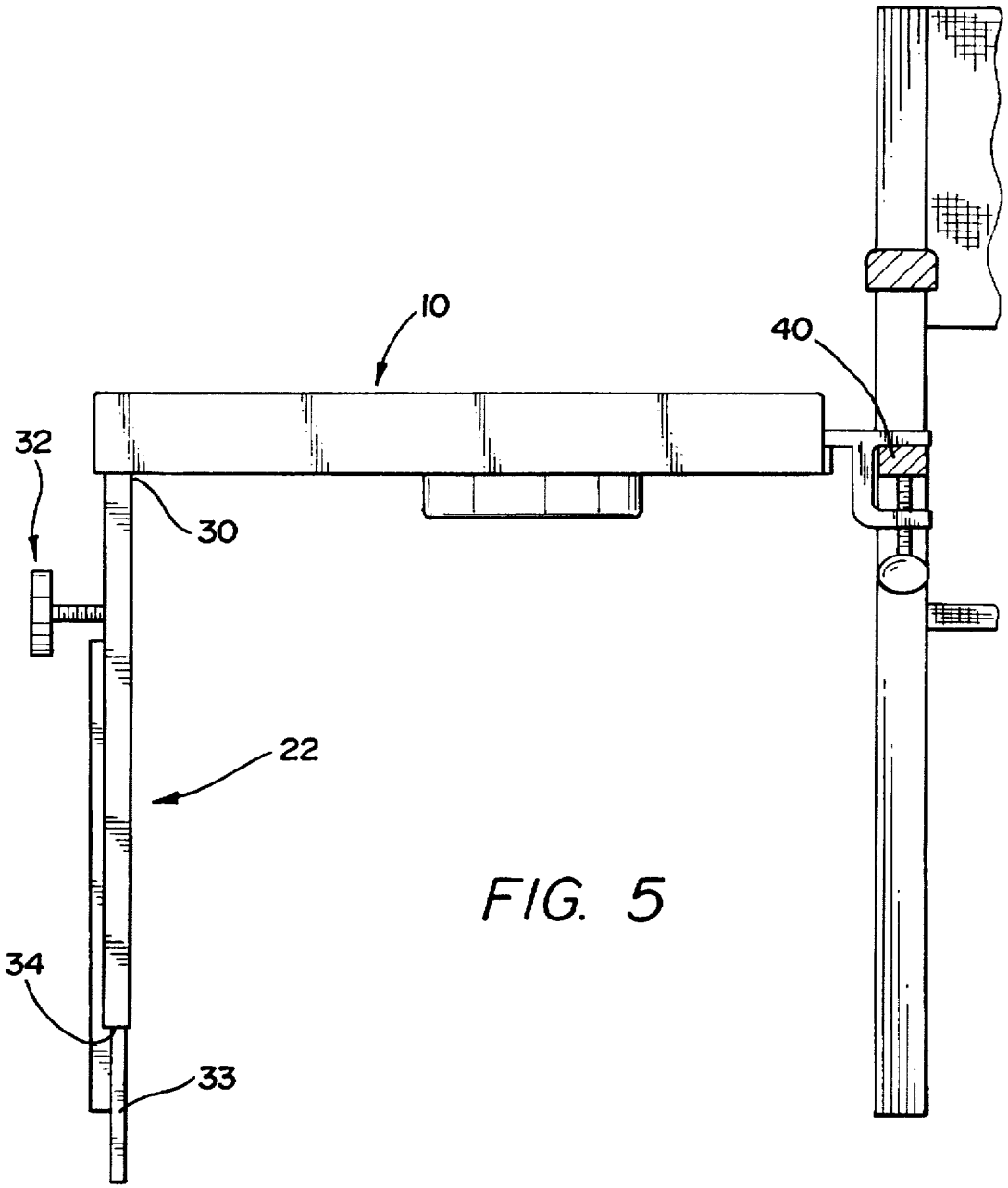

FIG. 3 discloses a further embodiment of the invention wherein VELCRO® straps 40*a* and 40*b* are inserted in slots 18 and 19 respectively. The straps 40*a* and 40*b* are then wrapped about the chair frame and secured together in a rapid assembly operation. In the embodiments of FIGS. 1–3, the tray 10 itself remains the same. The leg 22 is released and adjusted to engage the ground or sand and the clamps 25*a* and 25*b* or straps 40*a* and 40*b* engage the chair. The tray 10 as thus described, is economical, light and compact. It may readily be carried by beachgoers and assembled upon arrival.

While the invention has been explained by a detailed description of certain specific embodiments, it is understood that various modifications and substitutions can be made in any of them within the scope of the appended claims which are intended also to include equivalents of such embodiments.

What is claimed is:

1. A tray attachment for a chair having a substantially horizontal chair member to which the tray attachment is mounted comprising:

a substantially rectangular tray having a planar surface and upwardly extending side members along the periphery thereof;

outwardly projecting side portions on one of the tray side members each portion having an aperture extending outwardly therein;

a clamping member corresponding to each projecting side portion, said members each including an upper portion for insertion into the apertures, a downwardly extending portion and outwardly extending portion forming a C-shaped structure for mounting the horizontal chair member therein and threaded means inserted through the outwardly extending lower member to engage the chair member; and, a single chair leg pivotally mounted on the bottom of the tray, said leg having a telescoping portion extending outwardly therefrom and being pivotal at a right angle to the tray to provide support therefor.

2. A tray attachment for a chair having a substantially horizontal member to which the tray attachment is mounted in accordance with claim 1 wherein:

the clamping member comprises a Velcro® strap inserted through the aperture in the side portion and wrapping about the horizontal chair member.

3. A tray attachment for a chair having a substantially horizontal member to which the tray attachment is mounted in accordance with claim 1 wherein:

the chair member comprises a moveable and stationary V-shaped member, an upper surface for insertion into the tray aperture and a knob having downwardly extending threaded means to drive the movable member into engagement with the chair.

4. A tray attachment for a chair having a substantially horizontal member to which the tray attachment is mounted in accordance with claim 1 wherein:

the tray includes at least one slot on the surface thereof and the leg mounts to the slot when the leg is pivoted against the tray; and, said leg includes an outer envelope and an inner leg portion slidable within the envelope.

5. A tray attachment for a chair having a substantially horizontal member to which the tray attachment is mounted in accordance with claim 4 further including:

locking means engaging the telescoping leg to lock said outer envelope of the leg in position at a predetermined height.

6. A tray attachment for a chair having a substantially horizontal member to which the tray attachment is mounted in accordance with claim 5 wherein:

the outwardly projecting side portions each include snap lock tongues within the apertures to engage and hold the upper portions of the clamping member upon insertion into the apertures.

* * * * *